US009151293B2

(12) United States Patent
Mariotti

(10) Patent No.: US 9,151,293 B2
(45) Date of Patent: Oct. 6, 2015

(54) REVERSIBLE SYSTEM FOR INJECTING AND EXTRACTING GAS FOR FLUID ROTARY MACHINES

(75) Inventor: Gabriele Mariotti, Florence (IT)

(73) Assignee: Nuovo Pignone S.P.A., Florence (IT)

( * ) Notice: Subject to any disclaimer, the term of this patent is extended or adjusted under 35 U.S.C. 154(b) by 999 days.

(21) Appl. No.: 13/145,866

(22) PCT Filed: Jan. 22, 2010

(86) PCT No.: PCT/IB2010/000213
§ 371 (c)(1),
(2), (4) Date: Jul. 22, 2011

(87) PCT Pub. No.: WO2010/084422
PCT Pub. Date: Jul. 29, 2010

(65) Prior Publication Data

US 2011/0280710 A1 Nov. 17, 2011

(30) Foreign Application Priority Data

Jan. 23, 2009 (IT) ..... MI2009A0073

(51) Int. Cl.
*F04D 17/12* (2006.01)
*F04D 17/14* (2006.01)
*F04D 27/02* (2006.01)

(52) U.S. Cl.
CPC ..... *F04D 17/14* (2013.01); *F04D 27/0215* (2013.01)

(58) Field of Classification Search
CPC ..... F04D 15/0044; F04D 13/14; F04D 3/02; F04D 17/14; F04D 17/122; F04D 17/12; F04D 27/0215; F04D 27/207
USPC ..... 415/94, 101, 131, 152.1, 152.2, 154.3, 415/153.1, 203, 204, 205, 116, 117; 416/198 R, 198 A
See application file for complete search history.

(56) References Cited

U.S. PATENT DOCUMENTS 1,751,537 A * 3/1930 Vianello ..... 415/144
1,959,106 A 5/1934 Messing
(Continued)

FOREIGN PATENT DOCUMENTS

CN 86102901 A 7/1988
CN 1041992 A 5/1990
(Continued)

OTHER PUBLICATIONS

Office action from corresponding Chinese Application No. 2010800055894, dated May 6, 2013.
(Continued)

*Primary Examiner* — Dwayne J White
*Assistant Examiner* — Joshua R Beebe
(74) *Attorney, Agent, or Firm* — GE Global Patent Operation

(57) ABSTRACT

Herein described is a system for injecting and extracting gas for a fluid rotating machine of the type comprising at least one stator case, one first stage which receives the gas flowing into the machine, one final stage, downstream of which the gas is discharged from the machine, and one or more intermediate stages arranged between the first stage and the final stage. Each stage is made up of a single centrifugal rotor and a fixed ducting, associated to such centrifugal rotor and made on the single stator case. The system comprises at least one first worm screw for extracting gas from the machine and at least one second worm screw for injecting gas into the machine. Both worm screws for extracting gas and for injecting gas are operatively connected to at least one stage of the machine.

7 Claims, 4 Drawing Sheets

(56) References Cited

U.S. PATENT DOCUMENTS

| | | | | | |
|---|---|---|---|---|---|
| 4,715,778 | A | | 12/1987 | Katayama et al. | |
| 4,725,196 | A | * | 2/1988 | Kaneki et al. | 415/98 |
| 5,235,803 | A | * | 8/1993 | Rodgers | 60/785 |
| 5,791,159 | A | | 8/1998 | Aicher et al. | |
| 5,980,218 | A | * | 11/1999 | Takahashi et al. | 417/243 |
| 6,051,050 | A | * | 4/2000 | Keefer et al. | 95/96 |
| 6,267,560 | B1 | | 7/2001 | Charron | |
| 6,905,535 | B2 | * | 6/2005 | Keefer et al. | 96/125 |
| 2007/0110601 | A1 | * | 5/2007 | Lenderink et al. | 417/423.12 |
| 2007/0140889 | A1 | * | 6/2007 | Chen et al. | 418/183 |
| 2007/0151266 | A1 | * | 7/2007 | Yakumaru et al. | 62/197 |

FOREIGN PATENT DOCUMENTS

| | | | | | |
|---|---|---|---|---|---|
| CN | 1902402 | A | | 1/2007 | |
| CN | 200993111 | Y | | 12/2007 | |
| EP | 0301285 | A1 | | 2/1989 | |
| EP | 0757179 | A | | 2/1997 | |
| FR | 2040794 | A | | 1/1971 | |
| JP | H0510300 | A | | 1/1993 | |
| JP | H06257590 | A | | 9/1994 | |
| JP | H08200296 | A | | 8/1996 | |
| JP | H09-079192 | A | * | 3/1997 | F04D 29/44 |
| JP | H09119394 | A | | 5/1997 | |
| JP | H09144698 | A | | 6/1997 | |
| JP | H09273495 | A | | 10/1997 | |
| JP | 2007309154 | A | | 11/2007 | |

OTHER PUBLICATIONS

Search Report and Written Opinion from corresponding Italian Application No. MI20090073, dated Mar. 15, 2010.

Search Report and Written Opinion from corresponding PCT Application No. PCT/IB2010/000213, dated Jul. 15, 2010.

Unofficial English translation of JP Office Action dated Nov. 26, 2013 from corresponding Application No. 2011-546996.

* cited by examiner

REVERSIBLE SYSTEM FOR INJECTING AND EXTRACTING GAS FOR FLUID ROTARY MACHINES

CROSS-REFERENCE TO RELATED APPLICATIONS

This is a national stage application under 35 U.S.C. §371 (c) of prior-filed, co-pending PCT patent application serial number PCT/IB2010/000213, filed on Jan. 22, 2010, which claims priority to an Italian patent application serial number MI2009A000073, filed on Jan. 23, 2009, each of which is hereby incorporated by reference in its entirety.

BACKGROUND OF THE INVENTION

1. Field of the Invention

The embodiments of the present invention refer to a reversible system for injecting and extracting gas for a fluid rotating machine, in particular for a centrifugal compressor.

2. Description of Related Art

As known, a compressor is a machine capable of raising the pressure of a compressible fluid (gas) by using mechanical energy. Among the various types of compressors used in the industrial field process systems there are the so-called centrifugal compressors, wherein the energy to the gas is provided in form of centrifugal acceleration due to the rotation, generally driven by a driver (electric motor, vapor turbine or gas turbine), of a member referred to as rotor made up of one or more wheels or centrifugal rotors.

Centrifugal compressors may be provided with only one rotor, in the so-called single stage configuration, or several rotors arranged in series, thus referred to as multistage compressors. More precisely, each of the stages of a centrifugal compressor is usually made up of a pipe for suctioning the gas to be compressed, by a rotor, which is capable of providing kinetic energy to the gas, and a ducting for connecting a rotor to the following one, whose task is that of converting the kinetic energy of the gas discharging from the rotor into pressure energy. In particular, these ducts are made up of a first pipe portion for discharging from a rotor, referred to as a diffuser, a substantially U-shaped fitting referred to as "cross-over", and a second pipe portion for introduction into the subsequent rotor, referred to as return channel.

Modern multistage centrifugal compressors used in the petrochemical industry may be designed with systems for injecting and/or extracting gas on intermediate stages, also referred to as side streams. Some typical applications of these compressors are represented by machines used in refrigerators cycles, which use high molecular weight gases, such as propane and propylene, which are injected or extracted on intermediate stages depending on the process requirements. Extraction or injection of the gas is usually performed by means of worm screws or volutes made in the stator parts of the compressor, between two consecutive stages, in connection with an external flange.

Generally, the worm screw is substantially shaped to form a "spiral", which is extended circumferentially around the axis of the machine and which has a section suitably shaped to reduce the fluid dynamic loss to the maximum.

Given that efficiency and, generally, proper operation of a compressor depend on the aerodynamic losses in the stator parts, the injection and extraction worm screws must be designed to optimize in the geometry thereof to allow the correct flow of the gas both from inside the compressor to an external flange, for extraction systems, and from an external flange into the compressor, for the injection systems.

Up to date, centrifugal compressors provided with worm screws and respective systems for injecting and extracting gas on intermediate stages do not allow optimizing the gas stream, both when injecting and extracting, when such systems are installed on a single multistage compressor case. This is mainly due to the fact that traditional systems for injecting and extracting gas on intermediate stages provide for the use of a worm screw for each stage, leading to high loss of head when the gas is made to flow into the components of the system in the direction opposite to that provided for according to the design. In other words, the high velocities of the gas inside a compressor are such to create high loss of head should an extraction worm screw be used for injecting gas and vice versa.

An optimized operation in both modes is thus possible only if the centrifugal compressor is provided with a plurality of distinct cases operatively connected to each other by means of pipes that connect the outlet flange of a compressor case to the suction flange of the subsequent case. In other words, when a reversible system for injecting and extracting gas on intermediate stages with good efficiency is required, it is necessary to interrupt the compression with machines separated, executing and connecting the side stream outside the machine directly on the process pipe. This however implies increasing costs (for manufacturing the machine, laying the foundations, etc.) and lower reliability (higher number of auxiliary devices, connection pipes, etc.).

BRIEF SUMMARY OF THE INVENTION

Therefore, a general object of the embodiments of the present invention is that of providing a reversible system for injecting and extracting gas for a fluid rotating machine that is capable of overcoming the abovementioned problems of the prior art.

In particular, an object of the embodiments of the present invention is that of providing a reversible system for injecting and extracting gas for a fluid rotating machine capable of optimizing the gas stream, both in the injection and extraction mode, without requiring a very long compression train, made up of several stator cases connected to each other by means of external pipes.

Another object of the embodiments of the invention is that of providing a reversible system for injecting and extracting gas for a fluid rotating machine that is highly flexible to obtain side streams, simultaneously having the advantages of reliability, simplicity and relatively low costs of compressors provided with only one stator case.

These and other objects according to the embodiments of the present invention are attained by providing a reversible system for injecting and extracting gas for a fluid rotating machine, in particular for a centrifugal compressor, as outlined in claim 1.

According to an exemplary embodiment there is a system for injecting and extracting gas for a fluid rotating machine of the type comprising: at least one stator case, one first stage which receives the gas flowing into the machine, one final stage, downstream of which the gas is discharged from the machine, and one or more intermediate stages arranged between said first stage and the final stage, each stage being made up of a single centrifugal rotor and a fixed ducting, associated to the centrifugal rotor and made on the single stator case, wherein the single stator case is comprises: at least one first worm screw for extracting gas from the machine and at least one second worm screw for injecting gas into the machine, both worm screws for extracting gas and injecting gas being operatively connected to at least one stage of the machine in such a manner to allow the injection and/or extraction of the gas in a reversible manner through the at least one stage of the machine.

Further characteristics and advantages of the embodiments of the invention are highlighted by the dependent claims, which form an integral part of the present description.

BRIEF DESCRIPTION OF THE SEVERAL VIEWS OF THE DRAWINGS

Characteristics and advantages of a reversible system for injecting and extracting gas for a fluid rotating machine according to the embodiments of the present invention shall be clearer from the exemplifying and non-limiting description that follows referring to the attached schematic drawings, wherein.

DETAILED DESCRIPTION OF THE INVENTION

Figure 1:
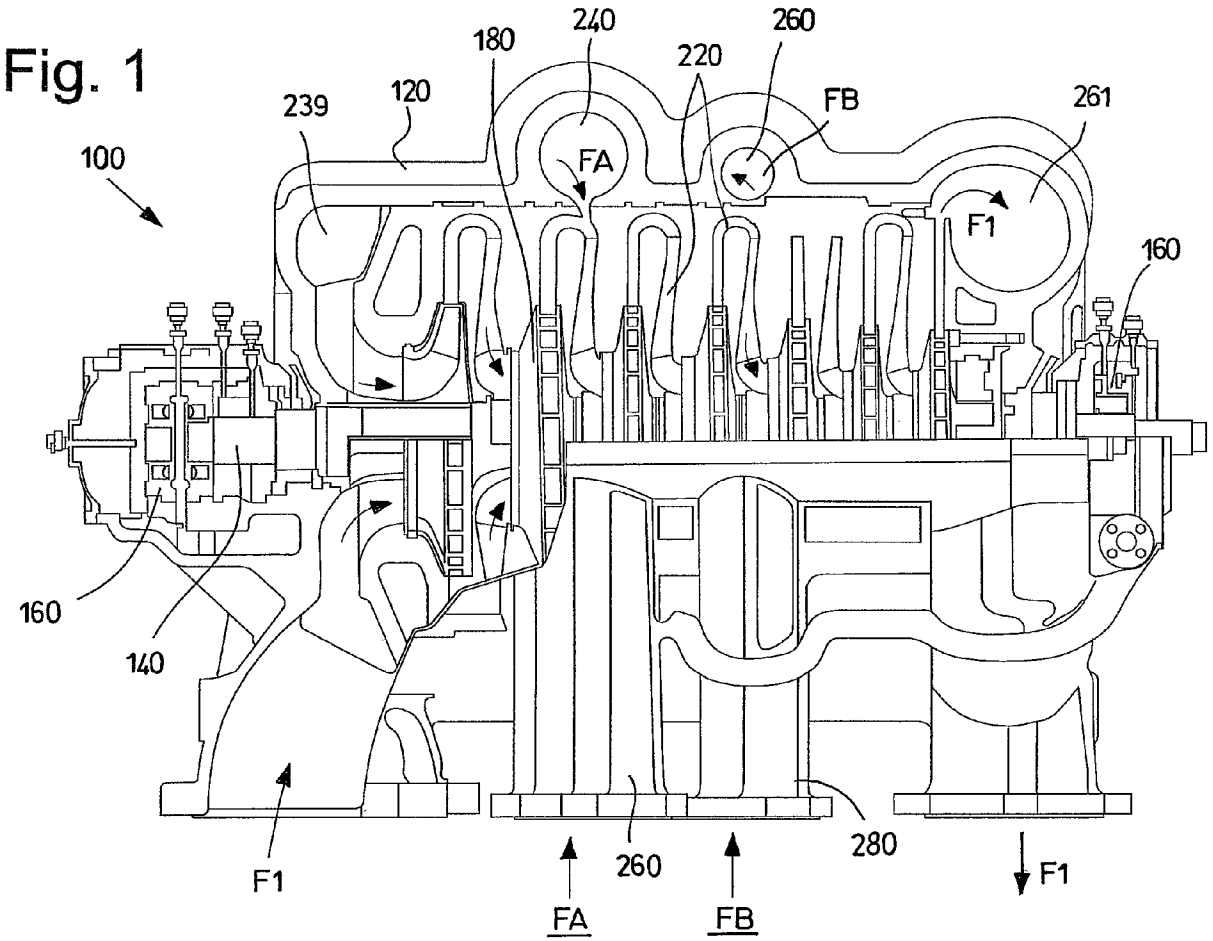
FIG. 1 is a partially sectioned schematic view of a general centrifugal multistage compressor, provided with a single stator case and a plurality of rotors keyed to the shaft between two support bushings.

Particularly referring to FIG. 1, schematically shown is a general centrifugal compressor of the prior art, of the multistage type, indicated in its entirety with reference number 100. The compressor 100 comprises a single stator case or casing 120 rotatingly mounted in which is a shaft 140 which lies on a plurality of support bushings 160. Keyed on the shaft 140 is a plurality of centrifugal rotors 180, one for each stage of the compressor 100. Each rotor 180 is in turn provided with a plurality of circumferential blades substantially extending radially. Thus, obtained on the casing 120 are ducts 220 which allow the compressible fluid (gas) to be conveyed from the outlet of the first rotor 180 towards the second rotor of the subsequent stage and so on, up to the final extraction of the gas from the compressor 100.

In particular, each of such ducts 220 is made up of a diffuser for discharging from the rotor 180, a substantially U-shaped fitting also referred to as "cross-over" and a return channel, not indicated in FIG. 1 for the sake of simplicity.

The compressible fluid (gas) enters into the compressor 100 from an inlet worm screw 239, it is subsequently conveyed into the single stages and thus exits from the compressor 100 itself through an outlet worm screw 261 (see the path indicated by the arrows F1).

Furthermore, the compressor 100 described therein is of the type comprising a first worm screw or intermediate injection volute 240 obtained in the stator case 120, which serves for fluid connection of a first side flange 260 with the ducting 220, and a second intermediate worm screw 260 for the fluid connection of a second side flange 280 with the ducting 220 of the subsequent stage. Further fluid streams are introduced from the side flanges 260 and 280 into the compressor 100, depending on the specific requirements of the system in question.

Figure 2:
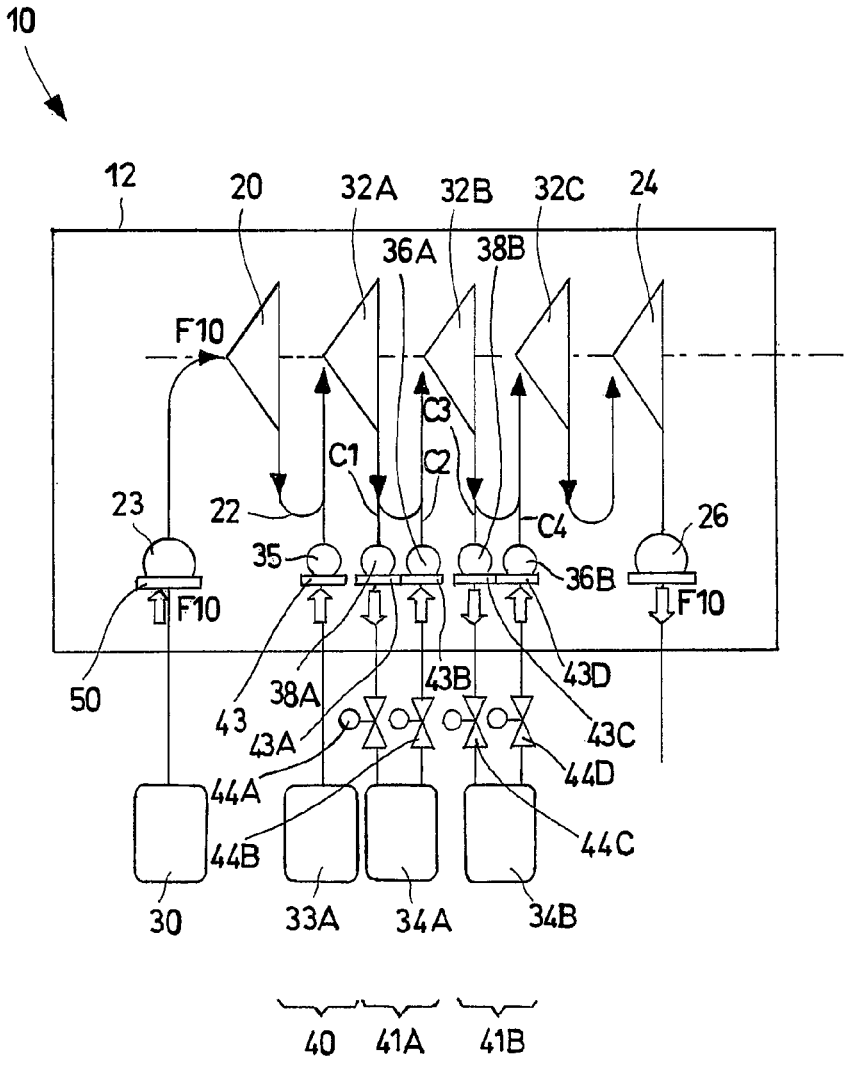
FIG. 2 is a diagram showing the operation of a reversible system for injecting and extracting gas according to the embodiments of the present invention, applicable to a general centrifugal multistage compressor.

The diagram of FIG. 2 shows a centrifugal compressor 10 according to an embodiment of the present invention, primarily highlighting, in an entirely schematic manner, the different stages that form the compressor 10, represented by a first stage 20 which receives the gas flowing in and by a final stage 24 downstream of which the gas is discharged from the compressor 10 itself (see the path indicated by the arrows F10).

Preferably connected upstream of the first stage 20 is a first worm screw or inlet volute 23 for suctioning the gas to be compressed into the compressor 10, coming for example from a storage reservoir 30 or from any other device of the system. Similarly, an outlet worm screw 26 for extracting the gas compressed by the compressor 10 is operatively connected downstream of the final stage 24. Advantageously provided for between the initial 20 and final 24 stages of the compressor 10 are three intermediate stages 32A, 32B and 32C which allow increasing the overall compression ratio obtainable using the compressor 10 itself.

It is obvious that the centrifugal compressor 10 is herein schematized for indicative purposes, given that it may be of any other type depending on the specific application, such as for example differing in terms of the number of stages, or not being provided with the inlet worm screw 23, or any other element.

According to an embodiment of the invention, additionally to the first suction worm screw 23 and the final outlet worm screw 26, the compressor 10 is provided with a side introduction system 40 and with side and reversible systems 41A and 41B for injecting and/or extracting gas respectively on the intermediate stages 32A, 32B and 32C, so as to obtain a so-called gas "side stream" at each single stage.

Figure 3:
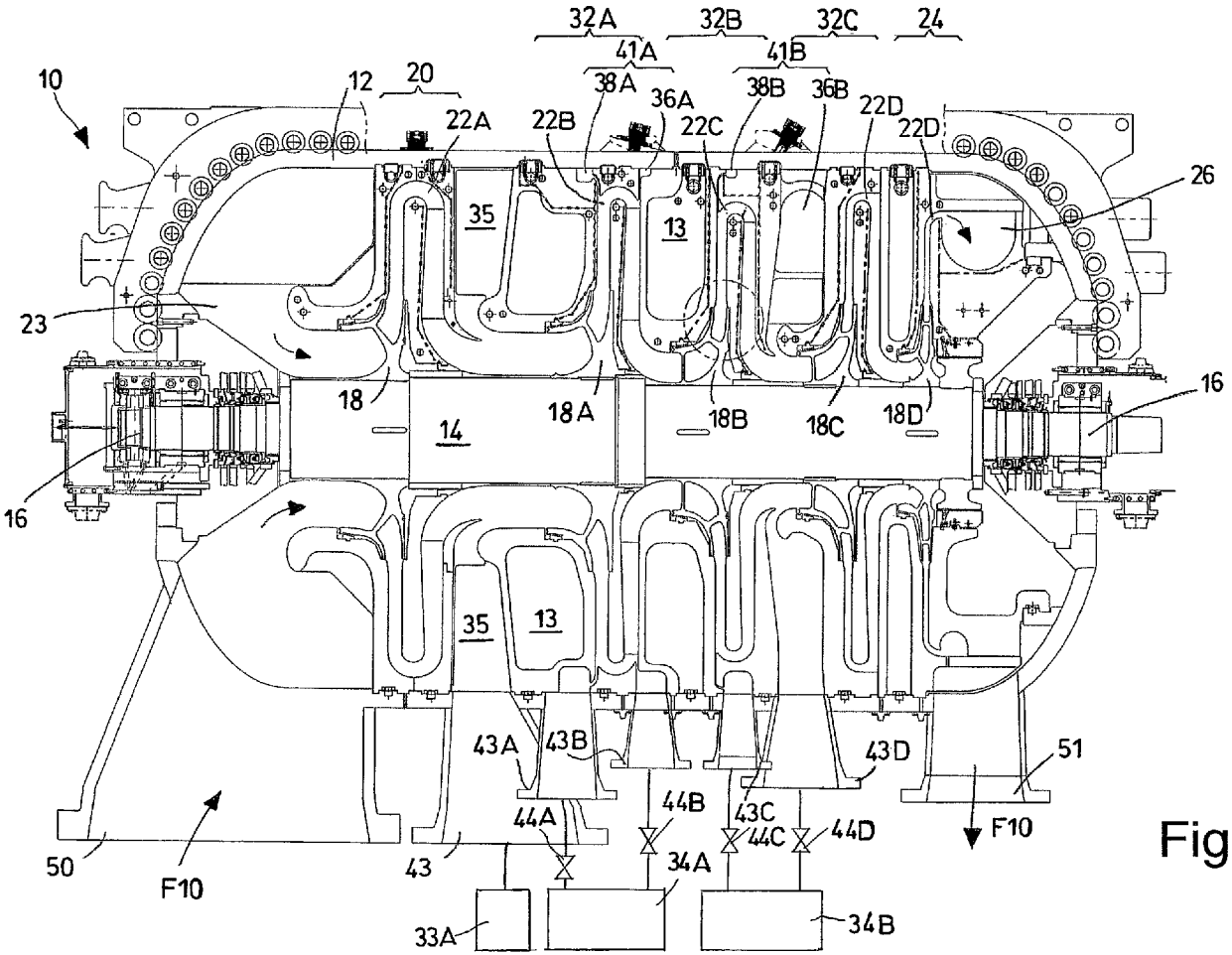
FIG. 3 is a vertical section schematic view of a centrifugal multistage compressor employing the embodiment of a reversible system for injecting and extracting gas shown in FIG. 2.
Figure 4:
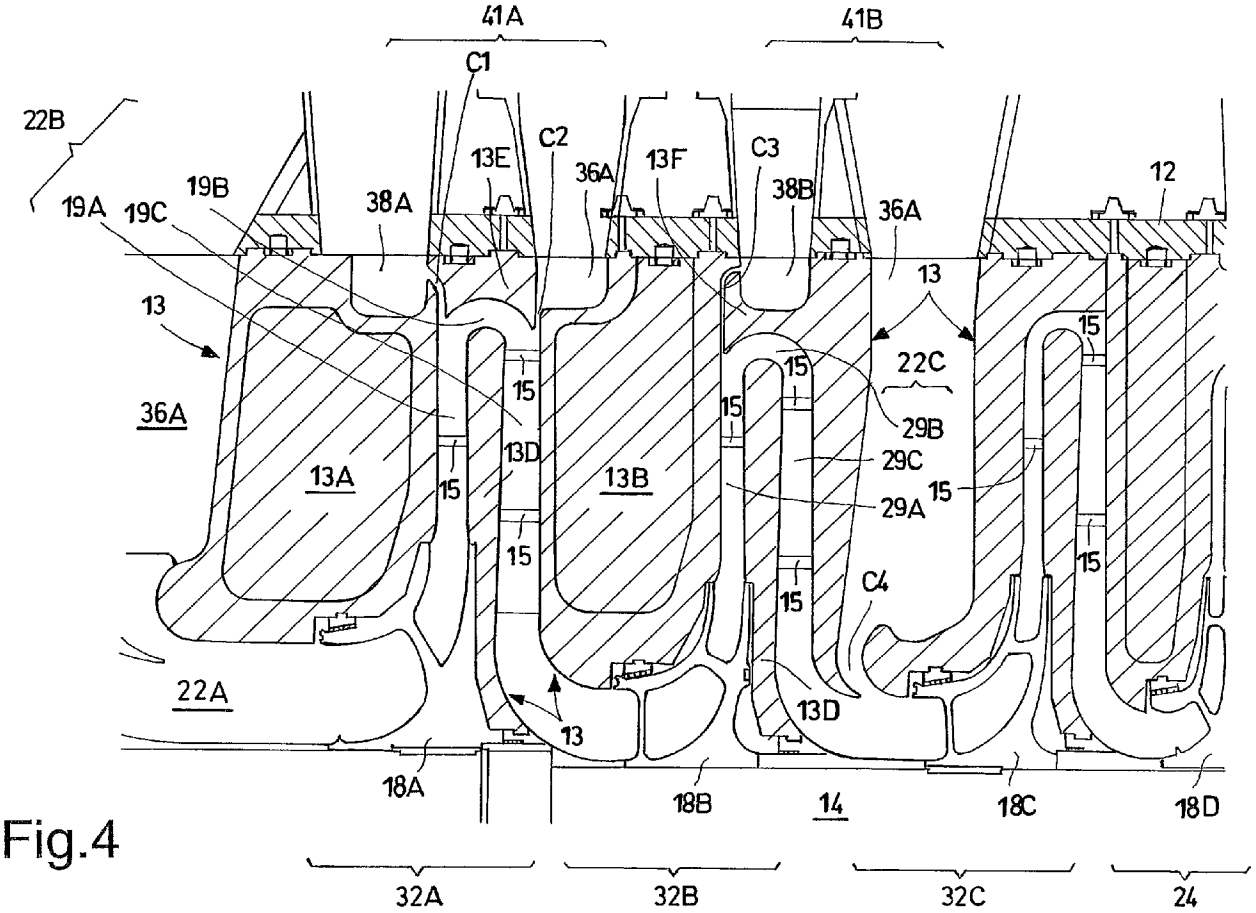
FIG. 4 is a vertical section view of an enlarged detail of the centrifugal multistage compressor of FIG. 3.

Depending on the system's requirements, the reversible injection and/or extraction systems 41A and 41B advantageously allow injecting or extracting, in the respective intermediate stages 32B and 32C to which they are associated, a further amount of gas, coming from special connection channels C1, C2, C3 and C4, and/or extracting from such intermediate stages 32B and 32C the gas—at a given intermediate pressure lower than the maximum pressure obtainable flowing out from the compressor 10—to send it to a specific system or storage reservoir, schematized in FIG. 2 with numbers 34A and 34B (also see FIGS. 3 and 4).

Such reversible injection and/or extraction systems 41A and 41B are advantageously and preferably associated to some of the intermediate stages 32B and 32C of a multistage centrifugal compressor 10, like in the case of the embodiment described herein, but they may be associated to all stages of the compressor 10 itself, or only to the final 24 and/or initial 20 stages, or they may also be mounted on a centrifugal compressor of the single stage type, or other elements, without departing from the scope of protection defined by the embodiments of the present invention.

In a preferable embodiment of the invention, in order to allow proper operation—in terms of overall efficiency—of the side stream of the gas, both when injecting into the compressor 10 and extracting from the same, each reversible system 41A and 41B comprises respective injection worm screws 36A and 36B and respective extraction worm screws 38A and 38B. Each intermediate stage 32A-32C is thus advantageously provided with a first extraction worm screw 38A-38B and a second injection worm screw 36A-36B, mounted inside the single stator case 12. Each worm screw 36A-36B and 38A-38B is in fluid communication with a respective outlet side flange 43A, 43B, 43C and 43D.

The abovementioned injection 36A-36B and extraction 38A-38B worm screws are designed in such a manner to have low coefficients of hydraulic loss only when the gas passes through the respective worm screw in the direction for which it has been designed. This allows using each reversible system 41A-41B for injecting and extracting gas according to the embodiments of the invention in a satisfactory manner even in the absence of isolation valves, i.e. with the flanges 43A-43D simply connected to the respective pipes for suctioning and extracting gas from the storage reservoirs 34A-34B or from the specific devices of the system.

FIG. 3 shows a vertical section of the centrifugal compressor 10 of FIG. 2, wherein it is particularly observable how the compressible fluid (gas) enters into the compressor 10 from an inlet flange 50 then introduced into the inlet worm screw 23. From the inlet worm screw 23 the gas is directed towards stages 20, 32A, 32B, 32C and 24 of the compressor 10, then it is discharged by the compressor 10 itself through an outlet worm screw 26 (see the path indicated by the arrows F10).

In the embodiment described in FIG. 3, the compressor 10 comprises a single stator case or casing 12, fixed on which is a stator part or diaphragm 13 and rotatingly mounted inside which is a shaft 14 which lies on a plurality of support bushings 16.

Each stage 20, 32A, 32B, 32C and 24 respectively comprises a centrifugal rotor 18, 18A, 18B, 18C and 18D, as well as ducts 22A, 22B, 22C, 22D and 22E which allow the compressible fluid (gas) to be conveyed to the outlet of a rotor of a given stage towards the rotor of the subsequent stage and so on, until the compressible fluid itself is discharged from the compressor 10. The ducts 22A, 22B, 22C, 22D and 22E are shaped in such a manner to convert the increase of the speed of the fluid obtained in the rotors 18, 18A, 18B, 18C and 18D into an increase of pressure.

Advantageously, the compressor 10 described herein comprises a first injection worm screw 35, obtained in the diaphragm 13, which serves for the fluid connection of a first side flange 43 arranged downstream of the ducting 22A. This first injection worm screw 35 is extended radially towards the shaft 14 and serves for introducing, downstream of the first rotor 18, further fluid stream from the system or external storage reservoir 33A.

Thus, the fluid passes through the second rotor 18A, flows through the ducting 22B and reaches the third rotor 18B. This ducting 22B comprises the reversible injection and/or extraction system 41A, having the extraction worm screw 38A and injection worm screw 36B described more in detail in FIG. 4.

Subsequently, the fluid passes through the third rotor 18B and flows through the ducting 22C. This ducting 22C is associated to the reversible injection and/or extraction system 41B, made up of the extraction worm screw 38B, which serves for extracting a part of the process fluid, and the injection worm screw 36B, configured to inject further fluid stream downstream of the rotor 18B.

After passing through the ducting 22C, the fluid flows through the fourth rotor 18C and thus through the ducting 22D to reach, without more gas being injected or extracted, the last rotor 18D, from which it reaches the outlet worm screw 26 through the ducting 22E to flow out from the machine 10 through the flange 51.

FIG. 4 shows an enlarged detail of the compressor 10 of FIG. 3, in which there can be observed particularly the ducting 22A, rotor 18A, the ducting 22B and the subsequent rotors 18B, 18C and 18D.

In particular, the ducting 22B comprises a first pipe portion 19A, for discharging from the rotor 18A, referred to as a diffuser, a substantially U-shaped intermediate fitting 19B also technically referred to as "cross-over", and a second pipe portion 19C for introducing into the subsequent rotor 1 SB, called return channel.

In the advantageous embodiment described in FIGS. 3 and 4, the extraction worm screw 38A is in fluid communication, at the end of the diffuser 19A, by means of a connection channel C1, shaped in such a manner to facilitate the flow of the fluid flowing out from the ducting 22B minimizing the fluid dynamic loss.

The injection worm screw 36A is also in turn advantageously and preferably in fluid communication, downstream of the fitting 19B, by means of a connection channel C2, shaped in such a manner to facilitate the flow of the inflowing fluid towards the ducting 22B minimizing the fluid dynamic loss.

Both worm screws 36A and 38A are respectively connected to two separate flanges 43A and 43B of the case 12. The flanges 43A and 43B may in turn be isolated from and towards the rest of the system or reservoir 34A, arranged outside with respect to the compressor 10, through respective valves 44A and 44B (see FIGS. 2 and 3).

In an advantageous embodiment, the subsequent ducting 22C comprises a diffuser 29A, an intermediate fitting or cross-over 29B, and a return channel 29C.

Advantageously, also in the ducting 22C the extraction worm screw 38A is in fluid communication, at the end of the diffuser 29A, by means of a connection channel C3, shaped in such a manner to facilitate the flow of the fluid flowing out from the ducting 22C minimizing the fluid dynamic loss.

The injection worm screw 36B is instead in fluid communication, downstream of the return channel 29C (and not downstream of the intermediate fitting, as in the case of the worm screw 36A), by means of a connection channel C4, shaped in such a manner to facilitate the flow of the inflowing fluid towards 1*a* ducting 22C minimizing the fluid dynamic loss.

It should be observed that the connection channels C1, C2 and C3, C4 may advantageously lead to any other position along the respective ducts 22B and 22C; hence, as far as its purpose is concerned, the description of FIG. 4 is not limitative but solely exemplificative with respect to a preferred embodiment of the invention.

Both worm screws 38B and 36B are respectively connected to two separate flanges 43C and 43D of the case 12. The flanges 43C and 43D may in turn be isolated from and towards the rest of the system or reservoir 34B, arranged outside with respect to the compressor 10, through respective valves 44C and 44D (see FIGS. 2 and 3).

The control of the "side stream" of the gas through each reversible system 41A-41B may be performed semi-automatically, or preferably automatically by means of a special actuation and control system.

In a particularly advantageous embodiment, the construction of the worm screws 38A, 36A, 38B and 36B may occur by providing the modular diaphragm 13 with a plurality of pieces, at least partially provided for on whose lateral surfaces may be the abovementioned worm screws. Thus, these lateral surfaces may be machined using traditional machine tools in a simple and inexpensive manner.

In an advantageous embodiment (see FIG. 4), the diaphragm 13 of each stage 32A and 32B according to the embodiments of the invention is respectively made up of an intermediate diaphragm 13A and 13B, a deflection diaphragm 13C and 13D and a fitting diaphragm 13E and 13F. Intermediate diaphragms 13A and 13B and fitting diaphragms 13E and 13F are fixed on the stator case 12, while deflection diaphragms 13C and 13D are fixed onto the intermediate diaphragms 13A and 13B by means of anchor elements or stator blades 15. In this case, the injection 36A and extraction 38A worm screws of the first stage 41A are provided for in the intermediate diaphragms 13A and 13B, while the injection 36B and extraction 38B worm screws of the second stage 41B are obtained in the fitting diaphragm 13F depending on the available space.

Obviously, such worm screws and/or the diaphragm may be made with other systems or operational methods, depending on the particular construction or use requirements.

It should be borne in mind that the worm screw is substantially a generally "spiral-shaped" component, extended circumferentially around the machine (as previously mentioned above), but such worm screw may also be configured to acquire a different shape or section depending on the particular construction or use requirements.

It has thus been observed how the reversible system for injecting and extracting gas for a fluid rotating machine according to the embodiments of the present invention attains the objects outlined previously. As a matter of fact, such system may be used to obtain a centrifugal compressor with side injections such to have optimal aerodynamic efficiency, both when extracting the gas and injecting the gas into the machine, with the entailed advantages of a compressor having a single stator case in terms of costs and reliability, and of a compressor having several distinct cases in terms of overall efficiency.

The reversible system for injecting and extracting gas for a fluid rotating machine of the embodiments of the present invention thus conceived is susceptible to various modifications and variants, all falling within the same inventive concept; furthermore, all details may be replaced by technically equivalent elements. In practice, the materials used, as well as shapes and dimensions, may vary depending on the technical requirements.

Thus, the scope of protection is defined by the attached claims.

The invention claimed is:

1. A system for injecting and extracting gas for a fluid rotating machine, the system comprising:

at least one stator case;

at least one first stage which receives the gas flowing into the machine;

at least one final stage, downstream of which the gas is discharged from the machine; and one or more intermediate stages arranged between the first stage and the final stage;

each stage made up of at least one centrifugal rotor and a fixed ducting, associated with the centrifugal rotor and made on the at least one stator case, wherein the at least one stator case comprises:

a first injection and extraction system comprising at least one first worm screw for extracting gas from the machine and at least one second worm screw for injecting gas into the machine;

wherein at least one stage has a return channel, wherein said fluid travels radially inward toward a next stage:

wherein the first and second worm screws for extracting gas and injecting gas are operatively connected to at least one stage of the machine in such a manner to allow the injection or extraction of the gas through the at least one stage of the machine;

wherein the second worm screw for injecting gas is in fluid connection, immediately downstream of a return channel of the ducting using a first connection channel shaped to facilitate the flow of the gas towards the ducting proximate a region where the flow changes from a radial flow to an approximately axial flow to minimize fluid dynamic loss.

2. The system according to claim 1, wherein the first worm screw for extracting gas and the second worm screw for injecting gas are mounted adjacent to each other on the stator case.

3. The system according to claim 1, wherein the first worm screw for extracting the gas is in fluid connection, at the end of a diffuser of the ducting using a second connection channel.

4. The system according to claim 1, wherein the second worm screw for injecting gas is in fluid connection, downstream of a fitting of the ducting, using a third connection channel.

5. The system according to claim 1, wherein the first worm screw for extracting gas and the second worm screw for injecting gas are respectively connected to two flanges separated by the at least one stator case.

6. The system according to claim 1, wherein the first worm screw for extracting gas and the second worm screw for injecting gas are made on lateral surfaces of components to be assembled together to form a diaphragm of the stator case.

7. The system according to claim 6, wherein the flanges are isolated from and towards the rest of the system arranged externally with respect to the machine using respective valves.

* * * * *